United States Patent [19]

Rubins et al.

[11] 4,150,539

[45] Apr. 24, 1979

[54] LOW POLLUTION COMBUSTOR

[75] Inventors: Philip M. Rubins, Manchester, Conn.; John Odgers, Quebec, Canada

[73] Assignee: Avco Corporation, Stratford, Conn.

[21] Appl. No.: 817,158

[22] Filed: Jul. 20, 1977

Related U.S. Application Data

[63] Continuation of Ser. No. 655,353, Feb. 5, 1976, abandoned.

[51] Int. Cl.[2] ..... F02C 7/22

[52] U.S. Cl. ..... 60/39.23; 60/39.71

[58] Field of Search ..... 60/39.23, 39.29, 39.36, 60/39.65, 39.71, 39.74 R, 39.72 R

[56] References Cited

U.S. PATENT DOCUMENTS

| | | | |
|---|---|---|---|
| 2,621,477 | 12/1952 | Powter et al. | 60/39.23 |
| 2,920,449 | 1/1960 | Johnson et al. | 60/39.74 R |
| 3,530,667 | 9/1970 | Bryan | 60/39.74 R |
| 3,577,878 | 5/1971 | Greenwood et al. | 60/39.23 |
| 3,724,207 | 4/1973 | Johnson | 60/39.74 R |
| 3,893,296 | 7/1975 | Fredriksen | 60/39.71 |
| 4,078,377 | 3/1978 | Owens et al. | 60/39.23 |

FOREIGN PATENT DOCUMENTS

| | | | |
|---|---|---|---|
| 552943 | 12/1956 | Italy | 60/39.74 R |

*Primary Examiner*—Robert E. Garrett

*Attorney, Agent, or Firm*—Irwin P. Garfinkle; Ralph D. Gelling

[57] ABSTRACT

A low pollution combustor is shown for controlling gas turbine pollutant emission, especially $NO_x$. Fuel is injected and mixed with air upstream of the combustion zone. An axially movable baffle controls the air flow so that the fuel-air ratio is precisely controlled passing into the primary combustion zone. A baffle recirculation zone prevents overheating of the walls. Dilution air is provided downstream of the primary zone for temperature dilution of the gases and to inhibit further formation of nitrogen oxides.

1 Claim, 3 Drawing Figures

LOW POLLUTION COMBUSTOR

This is a continuation, of application Ser. No. 655,353, filed Feb. 5, 1976 now abandoned.

BACKGROUND OF THE INVENTION

This invention relates generally to combustors and more particularly to a low pollution combustor for gas turbine engines.

During the process of combustion, maximum efficiencies are achieved when all the carbon and hydrogen have been converted to carbon dioxide and water, respectively. However, at high temperatures the two latter compounds break down, at least partially, into other substances such as carbon monoxide and hydrogen. At still higher temperatures, some of the nitrogen of the air reacts with any oxygen surplus to the combustion requirements, to form nitric oxide. Depending upon the exhaust conditions, many other products may appear in trace quantities.

In present day gas turbine combustors, fuel is injected into the combustion chamber where it vaporizes, mixes, and burns and is then diluted to reduce the temperature before entering the turbine. Pollutants such as carbon and carbon monoxide are generated therein by poor mixing, poor combustion, and the result of the addition of cooling air which quenches the chemical reaction. Nitric oxide is generated by high temperature and long residence time of the gases in the combustion chamber.

Accordingly, it is an object of this invention to provide a low pollution combustor which more effectively provides combustion of the air-fuel mixture and thereby reduces the pollutant found in the exhaust.

A still further object of this invention is to provide a low pollution combustor having an axially movable baffle for controlling air flow to the primary combustion zone.

SUMMARY OF THE INVENTION

This invention provides an improved combustor for gas turbine engines which reduces the amount of pollutants in the exhaust. The fuel and air are premixed upstream of the primary combustion zone and an axially movable baffle controls the air flow into the combustion zone. A dilution zone permits the injection of dilution air into the combustor to stop any chemical action in the production of pollutants.

Other objects, details, uses and advantages of this invention will become apparent as the following description of the exemplary embodiment thereof presented in the accompanying drawings proceeds.

BRIEF DESCRIPTION OF THE DRAWINGS

The accompanying drawings show a present exemplary embodiment of this invention in which.

DESCRIPTION OF ILLUSTRATED EMBODIMENT

Figure 1:
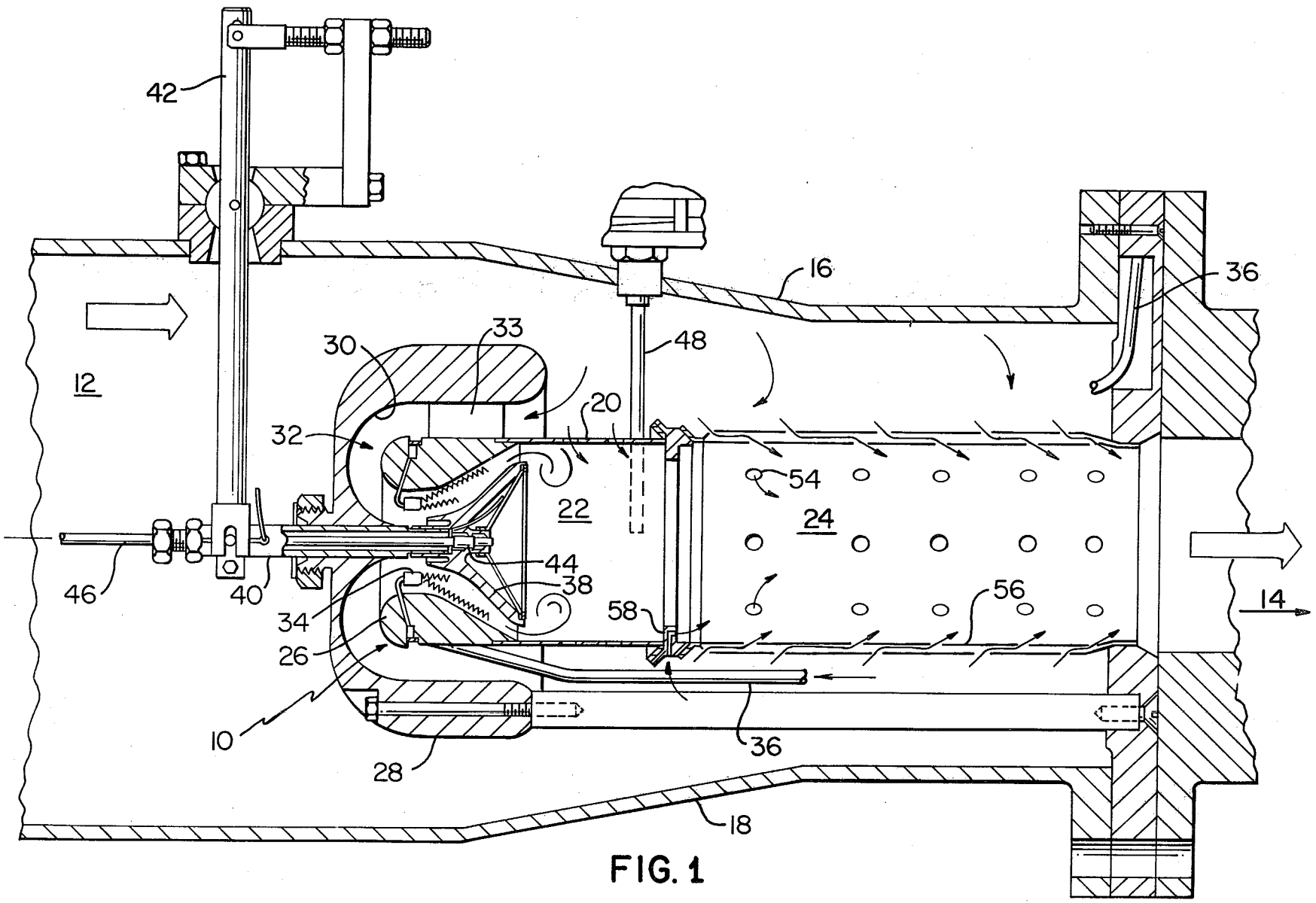
FIG. 1 is a cross-sectional view of the low pollution combustor of this invention.
Figure 2:
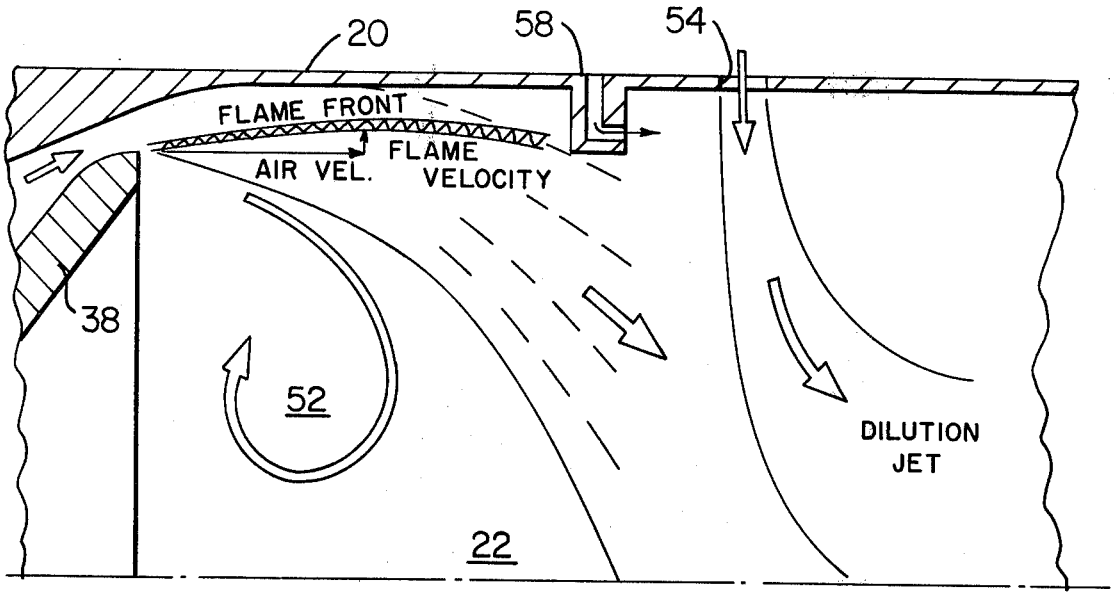
FIG. 2 is a diagrammatic representation of the flame path in the combustor of this invention.

Reference is now made to FIG. 1 of the drawings which illustrates one exemplary embodiment of the improved low pollution combustor of this invention, which is designated generally by the reference manual 10. The combustor 10 is fixedly mounted by suitable means in the air flow path, designated generally by arrows 12, upstream of the compressor turbine stage, the inlet of which is shown generally as 14. The combustor 10 can be used for either axial flow or reverse flow engines.

The combustor 10 is mounted between the outer and inner walls 16 and 18 which define an annular or cylindrical flow path. The combustor 10 generally comprises an annular or cylindrical housing 20 which defines a primary combustion zone 22 and a dilution zone 24. The upstream or inlet end of the combustor 10 is formed with an aerodynamically streamlined annular or cylindrical wall 26. For reverse flow, mounted about the inlet end of the combustor 10 is an annular or cylindrical envelope or wall 28 having a curved inside wall 30 which together with wall 26 defines an arcuate reverse flow passage 32 into the primary combustion zone 22. For axial flow, this reverse flow passage is omitted.

Mounted within the passage 32 is a plurality of fuel nozzles or atomizers 34. Fuel is supplied to the nozzles 34 through suitable fuel lines 36. It is thus seen that fuel is injected into the airstream and mixed therewith upstream of the combustion zone 22. Swirl vanes 33 are mounted in the passage 32 to impart a swirling motion to the air passing therethrough so that the air is given a swirling action about the axis of the combustor 10. The swirling action of the air enhances mixing of the fuel therein.

Mounted within the housing 20 at the inlet end thereof is an axially movable conically shaped baffle 38. The baffle 38 is mounted on arm 40 which is slidably mounted in wall 28 in the case of reverse flow. For axial flow, wall 28 is replaced by a sturdy support for a bearing surface for sliding arm 40. The arm 40 is operatively connected by linkage 42 to the fuel control such that the baffle 38 can be moved in the axial direction so as to precisely control the fuel air ratio in primary zone 22. A secondary fuel nozzle 44 is mounted in the baffle 38 and is fed by fuel line 46 extending through the arm 40 to the nozzle 44.

The combustor is spark ignited after which ignition immediately becomes self-sustaining. Thus, a spark plug 48 is retractably mounted in the housing 20. To ignite the combustor, the spark plug 48 is inserted into the housing 20 so as to ignite the fuel being ejected through the primary nozzles 34 or secondary nozzle 44, or a combination of both. The spark plug 48 is withdrawn and ignition is self-sustaining. Primary fuel is injected into the flow path 32 by nozzles 34 and mixes therewith. As the air-fuel mixture flows beyond the end of the baffle 38, ignition of such mixture occurs. The flame front is maintained away from the housing 20 of the combustor 10 due to the introduction of air through the housing 20 as represented by the arrows and because of the finite flame velocity. A part of the air-fuel mixture enters a recirculation zone 52 adjacent the baffle 38 due to the turbulence caused thereby. The velocity within the recirculation zone is low wherein the recirculation zone serves as an igniting source. Thus, the part of the fuel-air mixture within the recirculation zone provides the necessary hot gas to insure that the ignition is self-sustaining.

The housing 20 is formed with a plurality of ports 54 through which dilution air is injected into the fuel-air mixture. The dilution air tends to cool and retard the chemical action occurring due to the burning of the fuel-air mixture. In addition, if there is excess fuel within the mixture, the fuel will be burned out due to the introduction of the dilution air; and if the mixture is lean, the dilution air will merely be diluting the overall mixture. The downstream portion 56 of the housing 20 is formed of known construction such that secondary air is introduced into the combustor at selected points and mixed with the hot combustion gases before such gases enter the turbine section. Such secondary air also serves to cool the walls of the combustor in a known manner. Such cooling air is also introduced into the combustor 10 through baffle 58.

Figure 3:
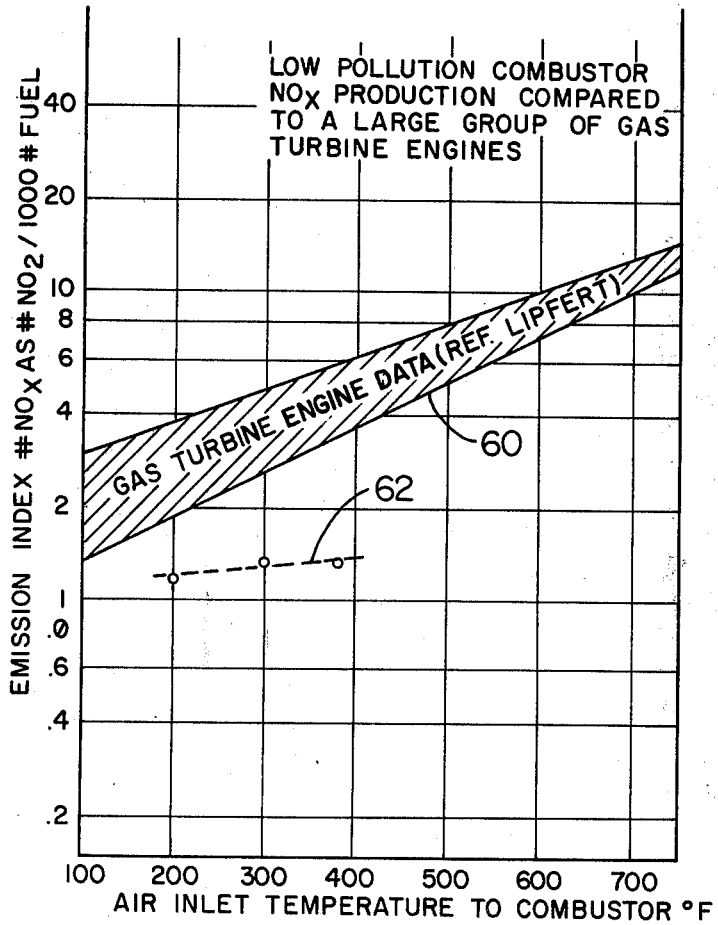
FIG. 3 is a chart showing the pollution production of the present invention as compared to a large group of gas turbine engines.

Referring now to FIG. 3, a chart is shown representing test results obtained utilizing a combustor as herein described. The section designated generally as 60 indicates typical $NO_x$ produced by a large group of gas turbine engines. Such engine data were corrolated by Lipfert. The section shown generally as 62 shows the $NO_x$ produced utilizing the low pollution combustor described herein. It is thus seen that through the use of the improved low pollution combustor a significant reduction is shown in the amount of $NO_x$ produced.

It should be noted that the preferred exemplary embodiment described herein is of the type in which the downstream portion of the housing 20 is provided with air passages therethrough. The air passages provide a means for cooling the walls of the combustor, as well as adding the secondary air to the gas mix. It is obvious that walls of a ceramic nature may be employed, said walls having apertures therein for the addition of the secondary air to the combustor. With the use of ceramic walls, it is, of course, not necessary to provide passageways to cool the walls.

While a present exemplary embodiment of this invention has been illustrated and described, it will be recognized that this invention may be otherwise variously embodied and practiced by those skilled in the art.

What is claimed is:

1. A low pollution combustor adapted to receive airflow from the compressor stage of a gas turbine engine and to discharge heated airflow therefrom to the turbine stage of the engine comprising:

a cylindrical combustor housing having forward and rear portions;

an aerodynamically contoured inlet mounted on the forward portion of the combustor housing and adapted to direct airflow into the housing; said inlet having a diverging cross section;

a support structure fixed at the entrance of the inlet;

a baffle mounted on the support structure for axial sliding movement thereon, said baffle extending into the inlet and being contoured to form in cooperation with the inlet a gradually restricted channel for the airflow as it flows through the inlet, said airflow being accelerated thereby to create a zone of recirculating airflow in the forward portion of the combustor housing;

fuel injecting means mounted in the inlet channel to premix fuel with the airflow prior to said airflow entering the forward portion of the combustor housing;

a plurality of swirl vanes mounted in the inlet upstream of the fuel injecting means to enhance the mixing of air and fuel;

control means connected to the baffle to adjust the axial position of the baffle thereby varying the fuel to air ratio of the airflow entering the combustor; and secondary fuel injection means mounted in the baffle to inject fuel into the recirculation zone.

* * * * *